US006234354B1

(12) United States Patent
Phillips et al.

(10) Patent No.: US 6,234,354 B1
(45) Date of Patent: May 22, 2001

(54) SOFT DRINK DISPENSING MACHINE WITH MODULAR CUSTOMER INTERFACE UNIT

(75) Inventors: Paul A. Phillips, Marietta, GA (US); Ellen Sandor O'Brien, Newport Coast, CA (US); Alfred A. Schroeder, San Antonio; William A. Edwards, Lavernia, both of TX (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 09/561,797

(22) Filed: May 1, 2000

(51) Int. Cl.[7] ..... B67D 5/56
(52) U.S. Cl. ..... 222/129.1
(58) Field of Search ..... 222/129.1, 129.2, 222/129.3

(56) References Cited

U.S. PATENT DOCUMENTS 4,781,310 * 11/1988 Credle, Jr. et al. ..... 222/129.3
4,801,048 * 1/1989 Credle, Jr. et al. ..... 222/129.1
5,190,188 * 3/1993 Credle, Jr. ..... 222/1

* cited by examiner

*Primary Examiner*—Kevin Shaver
*Assistant Examiner*—Stephanie L. Willatt
(74) *Attorney, Agent, or Firm*—Finnegan, Henderson, Farabow, Garrett & Dunner, L.L.P.

(57) ABSTRACT

A customer interface unit for a beverage dispensing machine facilitates configuration and assembly of the machine and reduces the amount of time required to fill orders for new equipment. The customer interface unit for soft drink machines of the disclosed embodiment facilitates reconfiguration of the machine and permits nozzles and associated plumbing to be added, removed, repositioned, repaired, or exchanged while in the field. These goals are accomplished by way of a modular construction which facilitates assembly and reconfiguration. The disclosed customer interface unit also includes a nozzle arrangement which facilitates visualization of the dispensing position by the customer, thereby minimizing the possibility of spillage.

10 Claims, 10 Drawing Sheets

SOFT DRINK DISPENSING MACHINE WITH MODULAR CUSTOMER INTERFACE UNIT

TECHNICAL FIELD

The present invention relates generally to soft drink dispensing machines and relates more specifically to a soft drink dispensing machine which has a modular construction to facilitate manufacture, repair, and reconfiguration.

BACKGROUND OF THE INVENTION

Soft drink dispensing machines are well known. Examples of known beverage dispensers include U.S. Pat. Nos. 4,781,310 and 4,801,048, both entitled "Beverage Dispenser," and commonly-owned U.S. Pat. No. 5,190,188, entitled "Convertible Beverage Dispenser." These patents are incorporated herein by reference.

Stated broadly, a soft drink dispensing machine is simply a device for chilling and for bringing together a flavored syrup and water (carbonated or non-carbonated, as may be appropriate) in the right proportions and for dispensing the drink into a cup. The soft drink dispensing machine thus has a number of components. The machine will include a source of one or more flavored syrups and a source of carbonated water, non-carbonated water, or both. The machine will include suitable plumbing for delivering the syrup and water to a mixing means. The machine will further include a means for chilling the water before it is mixed with the flavored syrup. And finally, the machine will include a component with which the customer interacts to dispense the soft drink through a nozzle and into a cup or other suitable container. This latter element will be referred to herein as the "customer interface unit."

The customer interface unit of a typical soft drink dispensing machine may have anywhere from one to twelve different dispensing stations. A dispensing station may be dedicated to a single flavor or may be capable of dispensing a variety of different flavors through a single nozzle. The customer interface unit further includes a means for actuating the machine to dispense a drink. In the case of a single-flavor nozzle, a lever is typically provided adjacent the nozzle, which is displaced by positioning a cup beneath the nozzle, thereby actuating the machine to dispense a soft drink through the nozzle until the cup is removed and the lever is released. In the case of a multi-flavor nozzle, the actuating mechanism will more typically consist of a series of buttons adjacent the nozzle, each button being associated with a different flavor. The customer positions a cup beneath the nozzle and presses one or more buttons to dispense one or more flavors of soft drink into the cup.

Formerly, the conventional practice was to position the customer interface unit of soft drink dispensing machines at a location where only the restaurant employees would have access to it. In recent years it has become more and more common to position the customer interface unit at a location where the restaurant patrons can have access to it, so as to permit the restaurant patrons to serve themselves. As used herein, the term "customer" shall be understood to include both restaurant employees and the consumers.

Depending upon the needs of the particular food service location, then, the customer interface unit of the soft drink machine may have one or a plurality of dispensing nozzles. The machine may be set up to dispense the same flavor from a number of nozzles, or it may be set up to dispense a number of different flavors, each through its own nozzle. In addition, some soft drink dispensing machines may have multi-flavor nozzles through which a variety of different flavors of soft drinks may be dispensed through a single nozzle, either in place of or in addition to dispensing nozzles dedicated to a single flavor. Because the number and type of nozzles and the number of flavors of soft drinks vary from installation to installation, soft drink machines have heretofore typically been custom configured for the particular installation. Because the plumbing interconnecting the syrup and water sources to the dispensing nozzles must be configured for the particular customer interface unit arrangement, custom-configuring a customer interface unit can be a time-consuming process. These various combinations and permutations of number of flavors, number of dispensing stations, and types of nozzles make for a large number of possible configurations for the customer interface unit of a soft drink dispensing machine. Consequently, conventional practice is to assess the restaurant operator's needs and then custom-manufacture a customer interface unit to address those needs. Thus a significant lead time is required to manufacture a customer interface unit to custom specifications, making it difficult to quickly fill orders for new equipment.

Thus there is a need for an improved customer interface unit for soft drink machines which facilitates configuration and assembly of the machine.

There is a further need for a customer interface unit for soft drink machines which reduces the amount of time required to fill orders for new equipment.

A further problem concerns the fact that soft drink requirements for a particular restaurant location may change over time. As consumer tastes change, as new flavors are introduced onto the market, or as the volume of business changes at a particular restaurant location, it may be desirable to add additional flavors or additional dispensing nozzles to an existing customer interface unit. Adding additional flavors, nozzles, or both can require running additional plumbing to the customer interface unit, removing and repositioning existing plumbing and valves, and adding new valves and nozzles. Reconfiguring a customer interface unit which has been custom-configured to a particular location can be a difficult and time-consuming process and is difficult to perform in the field.

Thus there is a need for an improved customer interface unit for soft drink machines which facilitates reconfiguration of the machine and which permits nozzles and associated plumbing to be added, removed, repositioned, or exchanged while in the field.

Another problem associated with conventional customer interface units is that the nozzles are positioned up underneath the customer interface unit in such a position that they can be difficult for the customer to see. This nozzle location can thus result in the customer not positioning his cup directly beneath the nozzle, with the result being spillage.

SUMMARY OF THE INVENTION

Stated generally, the present invention comprises an improved customer interface unit for a beverage dispensing machine which addresses the problems identified above. The disclosed customer interface unit for soft drink machines facilitates configuration and assembly of the machine and reduces the amount of time required to fill orders for new equipment. The customer interface unit for soft drink machines of the disclosed embodiment facilitates reconfiguration of the machine and permits nozzles and associated plumbing to be added, removed, repositioned, repaired, or exchanged while in the field. These goals are accomplished by way of a modular construction which facilitates assembly and reconfiguration. The disclosed customer interface unit also includes a nozzle arrangement which facilitates visualization of the dispensing position by the customer, thereby minimizing the possibility of spillage.

Thus it is an object of the present invention to provide an improved customer interface unit for soft drink dispensing machines.

It is another object of the present invention to provide an improved customer interface unit for soft drink dispensing machines which facilitates configuration and assembly of the machine and reduces the amount of time required to fill orders for new equipment.

Still another object of the present invention is to provide an improved customer interface unit for soft drink dispensing machines which facilitates reconfiguration of the machine and permits nozzles and associated plumbing to be added, removed, repositioned, repaired, or exchanged while in the field.

Yet another object of the present invention is to provide an improved customer interface unit for soft drink dispensing machines which facilitates visualization of the dispensing position by the customer, thereby minimizing the possibility of spillage.

Other objects, features, and advantages of the present invention will become apparent upon reading the following specification, when taken in conjunction with the drawings and the appended claims.

DETAILED DESCRIPTION OF THE DISCLOSED EMBODIMENT

Figure 1:
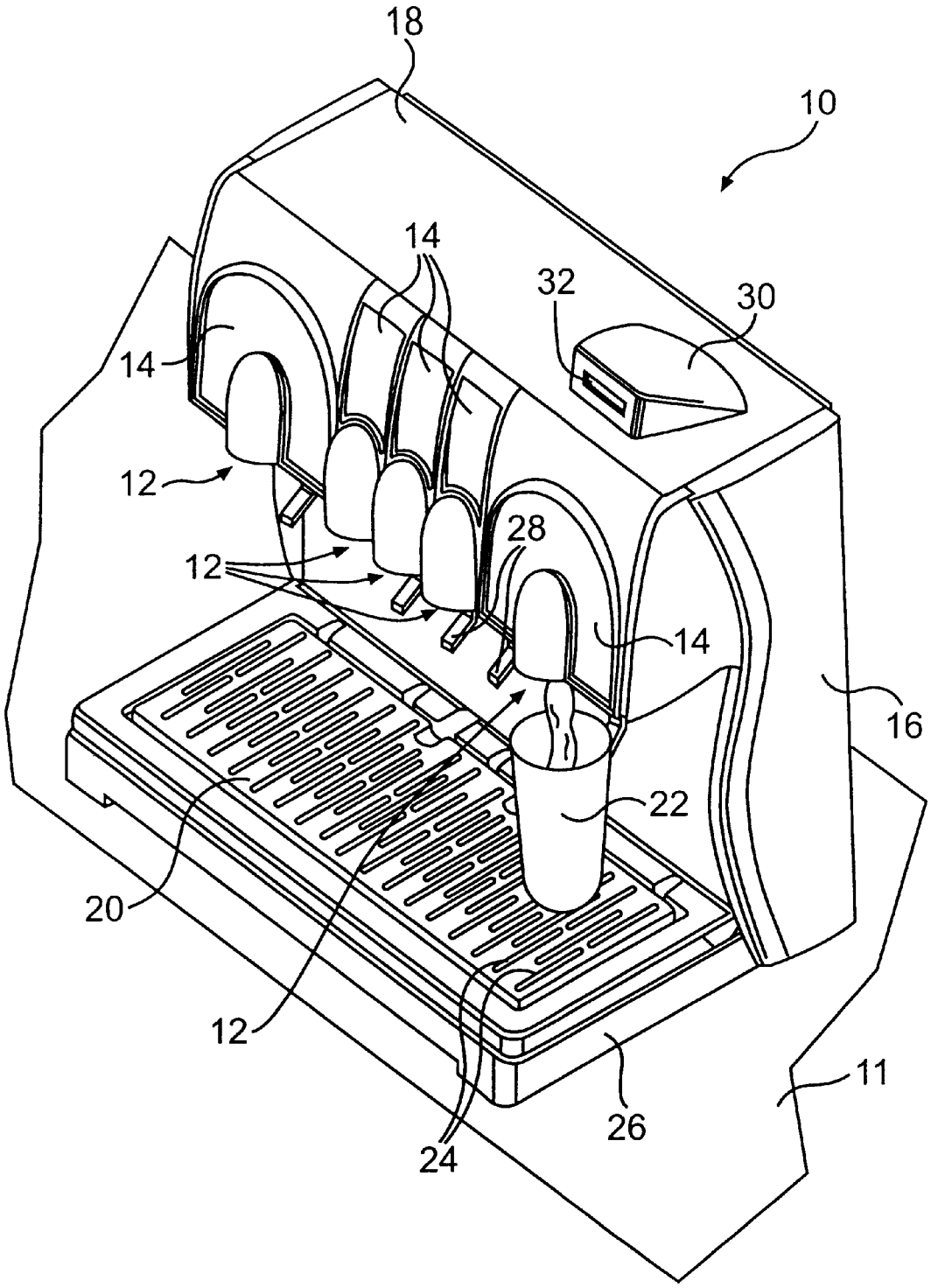
FIG. 1 is a perspective view of a modular customer interface unit according to the present invention.

Referring now to the drawings, in which like numerals indicate like elements throughout the several views, FIG. 1 shows a customer interface unit ("CIU") 10 of a soft drink dispensing machine. It will be understood that, in addition to the customer interface unit 10, the soft drink dispensing machine includes a source of carbonated water, a source of non-carbonated water, one or more flavored syrup sources, a means to chill the water and syrup, and various pump and metering devices, none of which are shown in the figures. These components may be kept beneath a counter 11 on which the customer interface unit 10 is mounted or may be stored in an adjacent room. Because all of these elements are well known to those of ordinary skill in the art, these components will not be described in detail.

The customer interface unit 10 illustrated in FIG. 1 includes five dispensing positions 12. As will be shown below, the number of dispensing positions 12 may vary from one to nine for the particular width of the customer interface unit 10, as dictated by the needs of the particular installation. Front covers 14 hinged at their upper ends form the front face of the customer interface unit 10. The remainder of the customer interface unit 10 is covered by flexible cladding, including side panels 16, a top panel 18, and a back panel (not shown). Beneath the dispensing positions 12 is a cup grid 20, which provides a platform for supporting a cup 22 while a soft drink is dispensed into it. The cup grid 20 includes a plurality of apertures 24 which permit spilled fluid to pass through the cup grid and into a drip tray 26 located beneath the cup grid.

At each dispensing position 12 is an actuation lever 28 which is located adjacent a dispensing nozzle (not shown in FIG. 1). Placing a cup 22 beneath a dispensing position 12 displaces the associated actuation lever 28 and causes a drink to be dispensed into the cup. Removing the cup 22 permits the actuation lever to be released, stopping fluid flow. As will be appreciated by those skilled in the art, other means of actuating the dispensing mechanism may be employed, such as push-button or portion timers, in place of actuation levers 28.

On top of the customer interface unit 10 and atop the top panel 18 is a diagnostic display 30 with LCD or LED readout 32. During normal operation the readout 32 can display a marketing message or operating instructions to the consumer. In the event of a malfunction, the readout 32 displays a diagnostic message which assists a technician in determining the cause of the malfunction.

Figure 2:
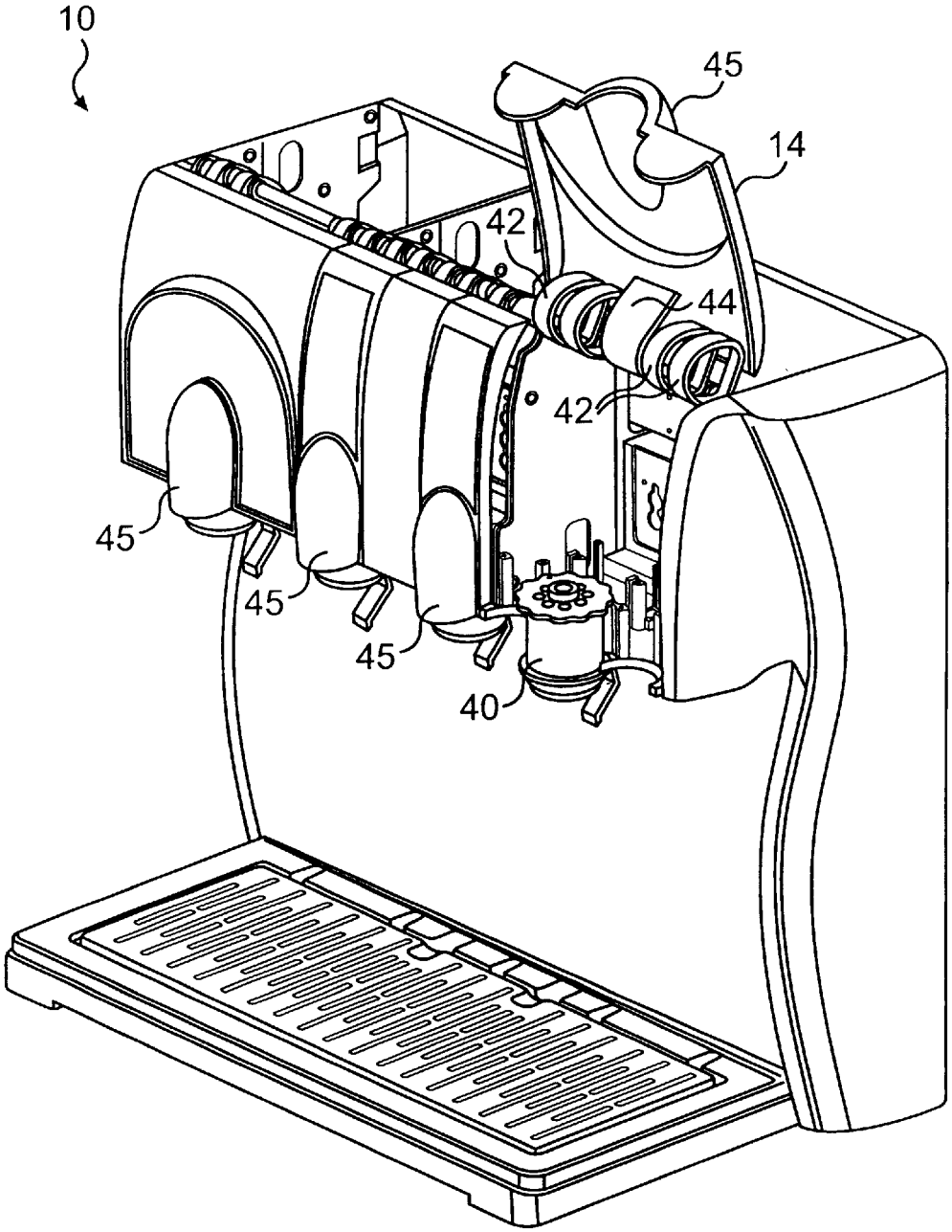
FIG. 2 is a perspective view of the customer interface unit of FIG. 1 with one access panel raised to reveal interior detail.

Referring now to FIG. 2, the front cover 14 on the right hand side of the customer interface unit 10 is opened, revealing a nozzle 40. The customer interface unit 10 may include single-flavor nozzles, which are dedicated to a single flavor, or multi-flavor nozzles, which permit a variety of different flavors of soft drinks to be dispensed through a single nozzle. An example of a multi-flavor nozzle is found in U.S. Pat. No. 5,725,125, the disclosure of which is incorporated herein by reference. The nozzle 40 shown in FIG. 2 is a multi-flavor nozzle, which comprises a plurality of concentric annular chambers around a central bore. Water (usually carbonated water) is dispensed through the central bore. Each annular chamber has a separate inlet and accommodates a single flavor of syrup. By having a separate chamber for each flavor, a syrup will not be contaminated by remnants of another flavor of syrup previously dispensed through the nozzle. All of the chambers dispense their syrup into the flow stream to mix with the water.

Also visible in FIG. 2 are the hinges 42 of the front cover 14 and a ribbon connector 44, which effects electrical connections between the front cover and the electronics module of the customer interface unit 10. The electronics of the customer interface unit 10 will be more fully described below.

As can be seen in FIGS. 1 and 2, the front covers 14 have rounded extensions 45 designed to conform generally to the contours of the nozzles 40. A front cover 14 may have a number of such rounded extensions 45 if necessary to accommodate a plurality of nozzles 40.

Figure 3:
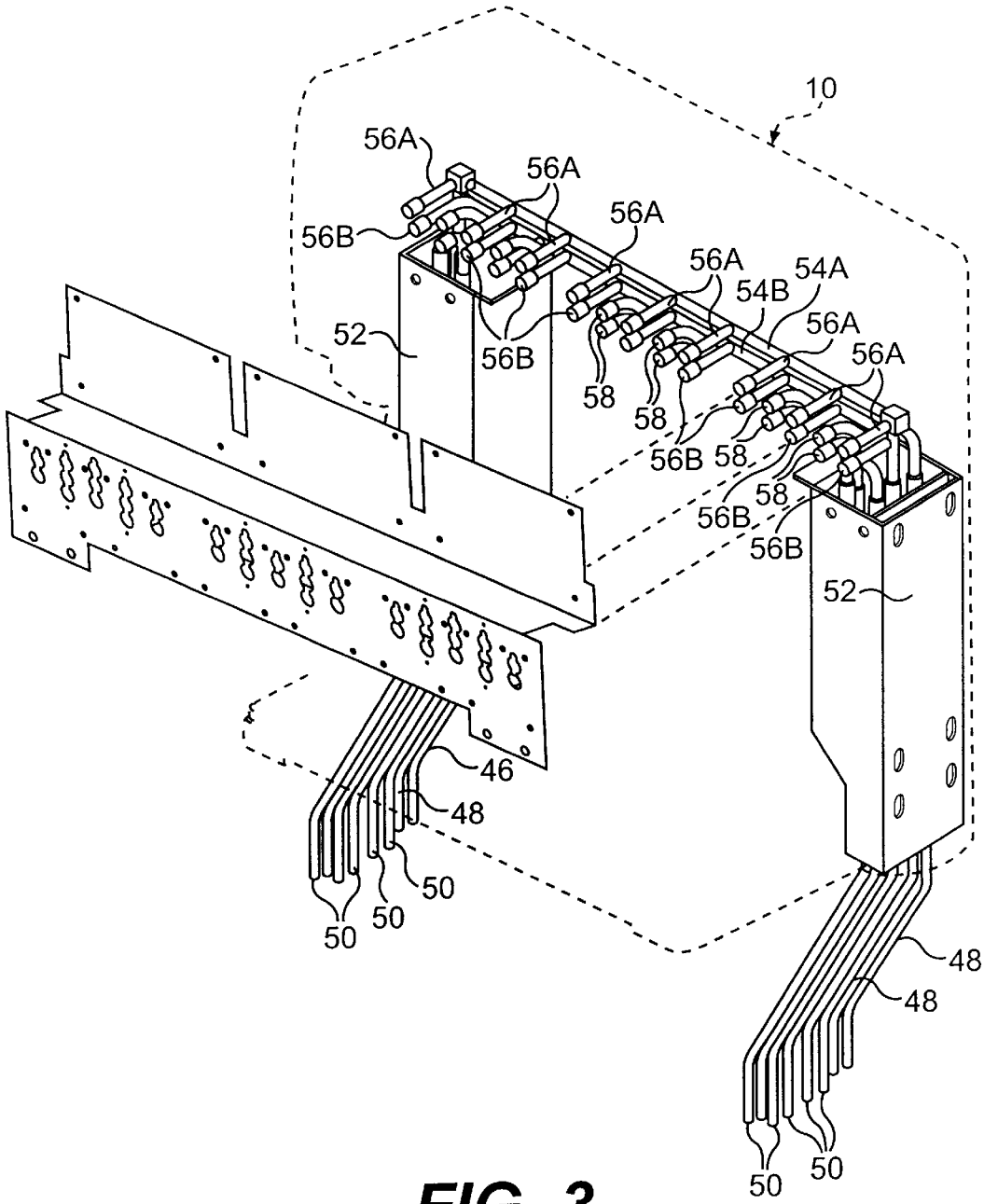
FIG. 3 is a perspective view of a manifold assembly and risers of the customer interface unit of FIG. 1, with a faucet plate shown exploded therefrom.

FIG. 3 illustrates a manifold assembly 46 which is housed within the customer interface unit 10. A plurality of water inlets 48 and syrup inlets 50 extend upward through a pair of hollow risers 52. A pair of water manifolds 54A, 54B are stacked one above the other. Each of the water manifolds 54A, 54B is in fluid connection with a pair of water inlets 48, one at each end of the water manifold, such that every point within each water manifold is under fluid pressure from both ends. Each water manifold 54A, 54B includes nine outlets 56A, 56B, the stacked water manifolds thereby forming nine pairs of outlets. In the disclosed embodiment one of the water manifolds is adapted to supply carbonated water to the customer interface unit 10, and the other water manifold is adapted to supply non-carbonated water.

The manifold assembly 46 further comprises twelve syrup conduits 58. The end portions of the syrup conduits 58 are arranged in six stacked pairs, one pair of syrup conduit end portions being located in each of the following locations: between the first and second pairs of water outlets 56A, 56B; between the second and third pairs of water outlets; between the fourth and fifth pairs of water outlets; between the fifth and sixth pairs of water outlets; between the seventh and eighth pairs of water outlets; and between the eighth and ninth pairs of water outlets. It will be noted that no end portions of syrup conduits 58 are located between the third and fourth pairs or between the sixth and seventh pairs of water outlets 56A, 56B, for reasons which will become apparent.

It will be understood that the manifold assembly 46 described above is intended for use with a customer interface unit 10 of a particular width, and that customer interface units which are narrower or wider will have fewer or more water outlets 56A, 56B and syrup conduits 58.

Shown exploded away from the manifold assembly 46 and the risers 52 is a faucet plate 70. Cutouts 72 are formed in the front panel 73 of the faucet plate 70. A horizontal panel 77 extends rearward from the upper end of the front panel 73, and a rear panel 78 extends upward from the rearward end of the horizontal panel 77. The faucet plate 70 mounts to the risers 52, with the water outlets 56A, 56B and syrup conduits 58 being received through the cutouts 72 in a manner which will be described in more detail below.

Figure 4:
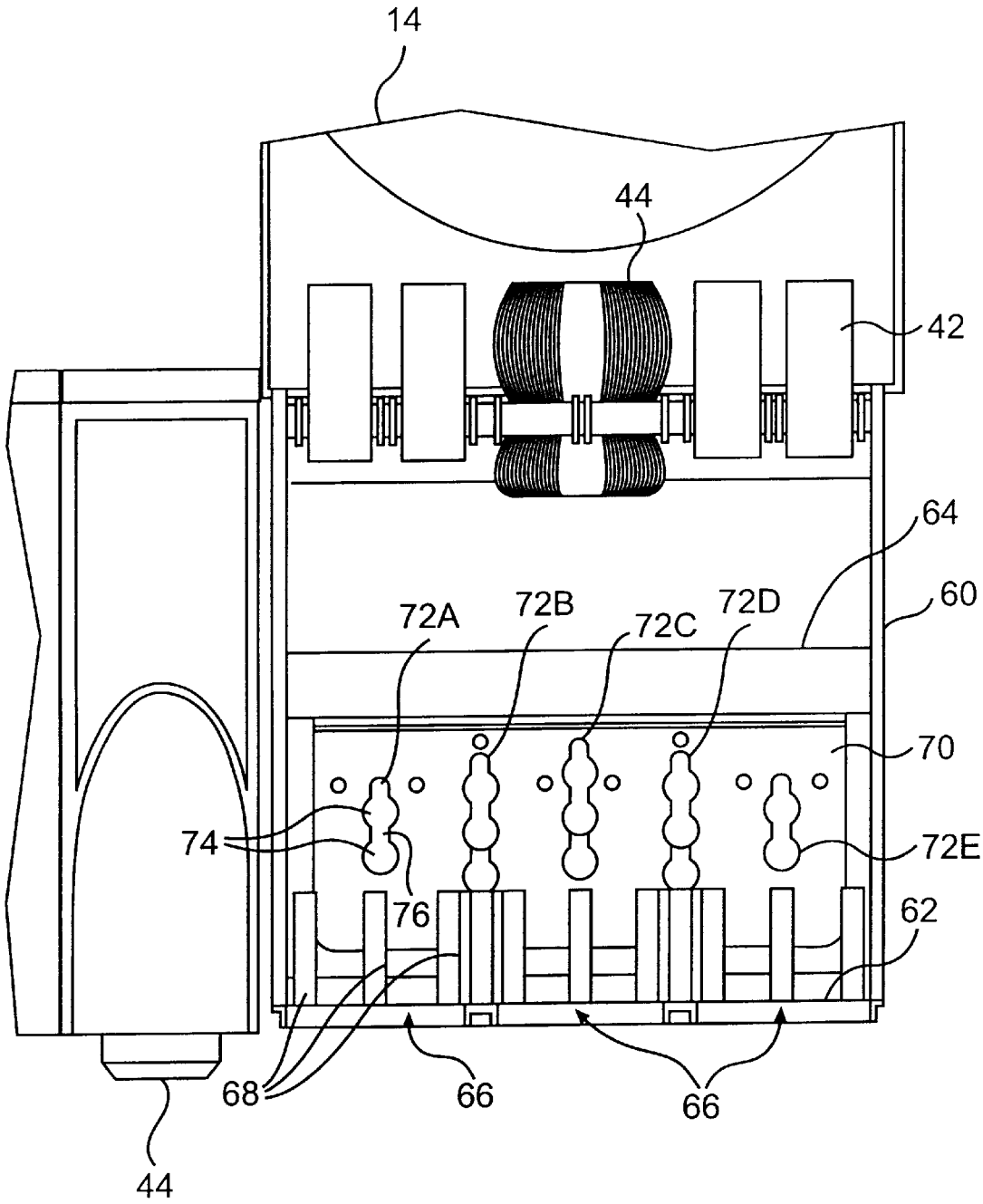
FIG. 4 is a front view of the upper right-hand portion of the customer interface unit of FIG. 2 with the cover raised to reveal a valve tray.
Figure 5:
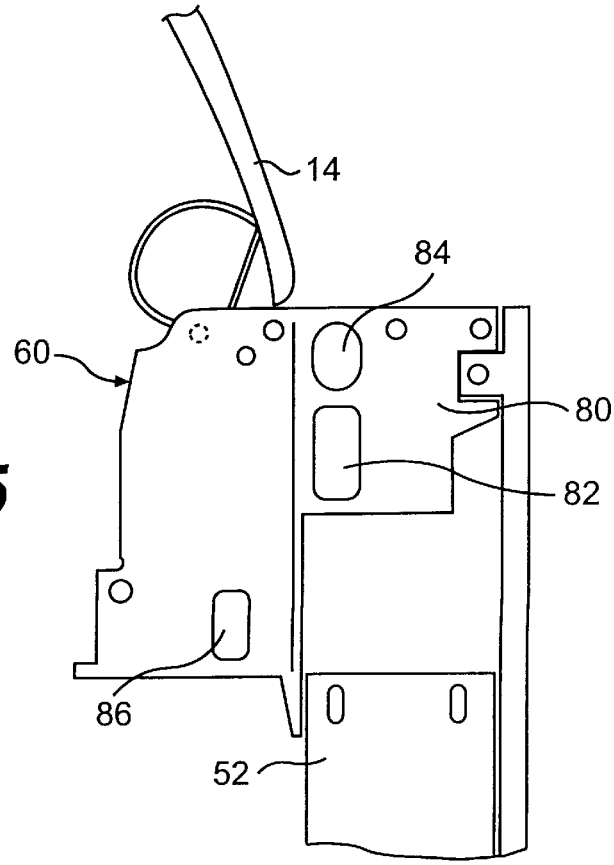
FIG. 5 is an end view of the upper right-hand portion of the customer interface unit of FIG. 1 with the side cladding removed to reveal the valve tray.
Figure 6:
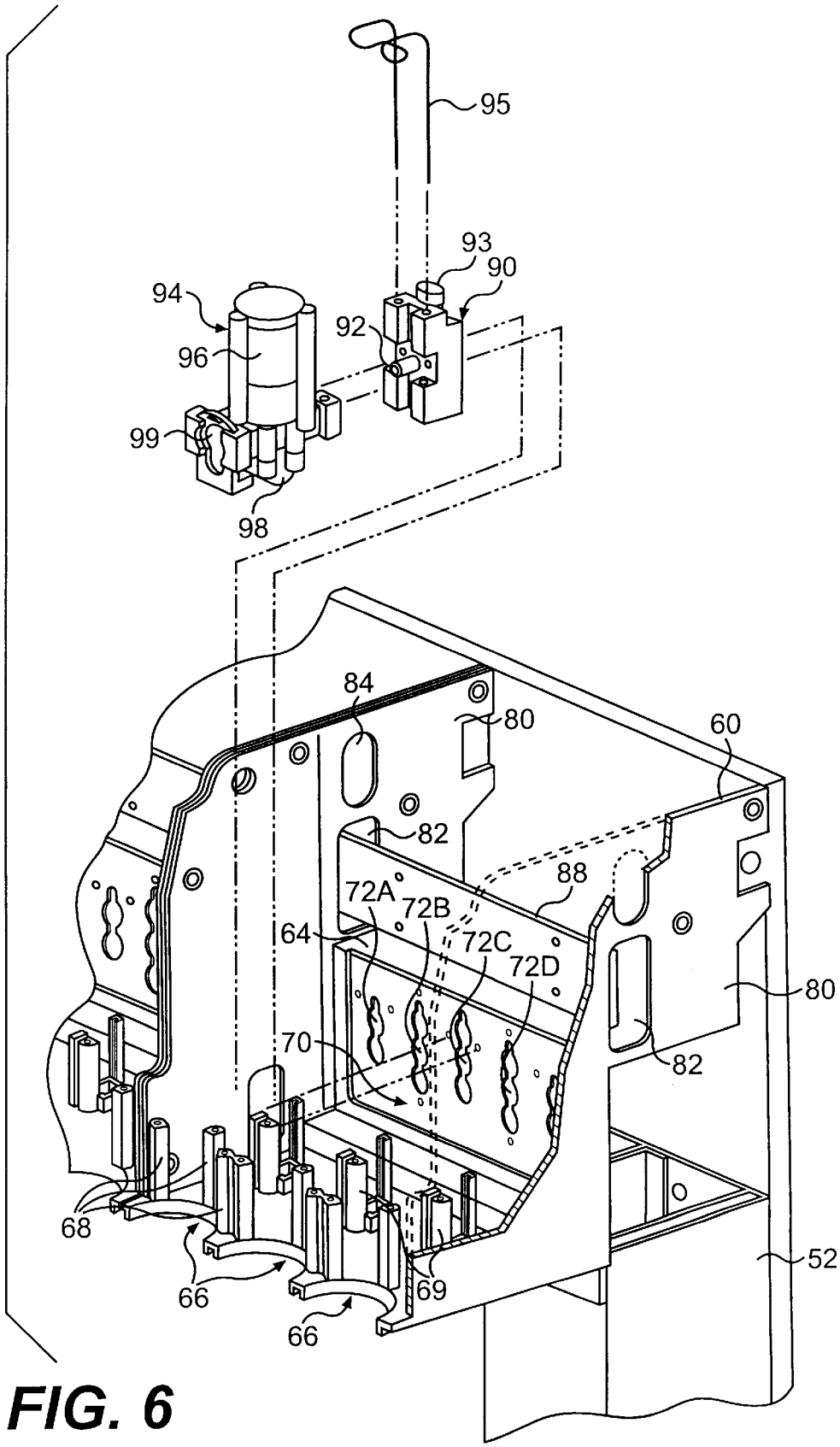
FIG. 6 is a perspective view of the valve tray of FIG. 4 showing a water mounting block and water valve exploded therefrom.

Referring now to FIGS. 4–6, a valve tray 60 is depicted. As can be seen in FIGS. 4 and 5, each valve tray is tiered and includes a lower platform 62 and an upper platform 64. The back of the valve tray 60 between the lower and upper platforms 62, 64 is open. The valve trays 60 mount to the faucet plate 70 and are fastened thereto with screws or other suitable fasteners. The faucet plate 70 thus serves the function of a support structure for the valve trays 60.

As can be seen in FIG. 4, the lower platform 62 includes three semicircular cutouts 66 and its forward edge. The semicircular cutouts 66 define pre-configured locations for nozzles 40. Stated differently, each dispensing position 12 comprises a semicircular cutout 66. Around each semicircular cutout 66, a plurality of support bosses 68 extend upward from the lower platform 62 of the valve tray 60. The support bosses 68 serve as mounting locations for the nozzles 40, as will be more fully described below. Also extending upward from the lower platform 62 of the valve tray 60 are bosses 69 for mounting circuit boards (not shown) associated with the actuation levers 28 (FIG. 1).

Still referring to FIG. 4, the faucet plate 70 is visible through the open back of the valve tray 60 between the lower and upper platforms 62, 64. Each cutout 72 of the faucet plate 70 has a plurality of substantially circular portions 74 interconnected by narrower neck portions 76, the cutouts 72B–D including three circular portions 74, and the cutouts 72A, 72E each including only two circular portions 74. Circular portions 74 of the cutouts 72A, 72C, and 72E are aligned with the outlets 56A, 56B of the water manifolds 54A, 54B, while circular portions of the cutouts 72B and 72D are aligned with end portions of syrup conduits 58.

While only a portion of the faucet plate 70 is visible in FIG. 4, it will be understood that the faucet plate 70 is mounted to the risers and extends across substantially the entire width of the customer interface unit. The faucet plate includes a number of groups of cutouts 72A–E, one group of cutouts for each valve tray 60. The faucet plate 70 also serves as the support structure for the valve trays 60.

With regard to cutouts 72B, 72D, it will be appreciated that each such cutout has three circular portions 74, whereas there are only two corresponding syrup conduits 58. The third circular portion 74 of the cutouts 72B, 72D is adapted to receive a conduit separate from the manifold assembly 46 to deliver a "bonus flavor," as will be further explained below. Similarly, while each cutout 72C includes three circular portions 74, there are only two corresponding outlets 56A, 56B. The third wide circular portion 74 of the cutout 72C is adapted to receive an end portion of a conduit for ambient temperature water separate from the water manifolds 54A, 54B.

With reference to FIGS. 5 and 6, each valve tray 60 includes side walls 80. Apertures 82, 84 are formed in the side walls 80 of the valve tray 60 at a location just above the upper platform 64 of the valve tray. Additional apertures 86 are formed in the side walls 80 of the valve tray 60 at a location just above the lower platform 62 of the valve tray. When a plurality of valve trays 60 are positioned in side-by-side relation, as shown in FIG. 6, the apertures 82, 84, 86 of each valve tray align with the corresponding apertures 82, 84, 86 in the adjacent valve tray, forming through passages extending across multiple valve trays 60. As shown in FIG. 6, a circuit board 88 resides on the upper platform 64 of the valve trays 60 within the apertures 82. The passageway formed by the apertures 84 is adapted to receive electrical cables, and the passageway formed by the apertures 86 is adapted to receive fluid conduits.

With further reference to FIG. 6, the customer interface unit 10 further comprises a water mounting block 90. The water mounting block 90 mounts to the faucet plate 70 overlying a cutout 72C. The water mounting block 90 includes fittings in its back wall for coupling to outlets 56A, 56B from the water manifolds 54A, 54B. The water mounting block 90 includes an outlet tube 92 extending forward from its front wall. A selector stem 93 located at the upper rear portion of the water mounting block 90 operates a three-way internal valve within the water mounting block. The selector stem 93 can be set to cause the internal valve to direct fluid flow from either of the water manifold outlets 56A, 56B through the outlet tube 92 or to an "off" position which prevents any fluid flow through the outlet tube.

While only one water mounting block 90 is shown in FIG. 6, it will be understood that a like water mounting block 90 is installed over each cutout 72A, 72C, and 72E of the faucet plate 70 and coupled to the associated water manifold outlets 56A, 56B. In the event that fewer than the maximum number of dispensing positions 12 are operative for a given customer interface unit 10, the internal valve of the unused water mounting block(s) 90 will simply be set to the "off" position.

For each operational dispensing position 12 of the customer interface unit 10, a water module 94 couples to the water mounting block 90 and receives fluid flow from the outlet tube 92 of the water mounting block. A retainer clip 95 includes two downward extending legs which pass through holes in the water mounting block 90 and the water module 94 to hold the water module on the mounting block. Each water module 94 includes a solenoid body 96 which houses a solenoid to electronically open and close an internal valve. Each water module 94 also includes a flow meter 98 to measure fluid flow through the water module. At the lower front portion of the water module 94 is an outlet port 99.

Figure 7:
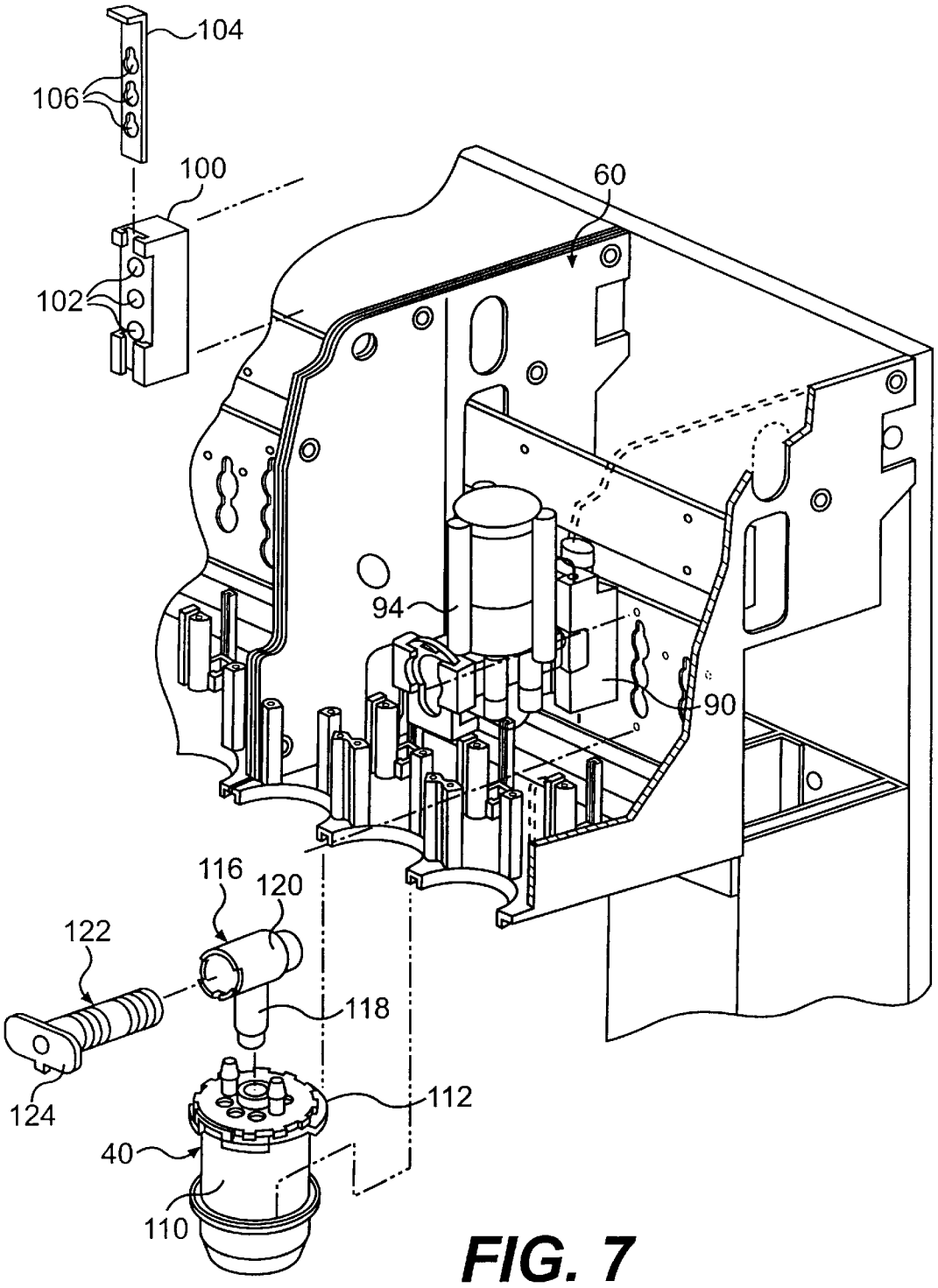
FIG. 7 is a perspective view of the valve tray of FIG. 6 showing the water mounting block and the water block installed on a faucet plate and showing a syrup connection block and nozzle assembly exploded therefrom.

Now referring to FIG. 7, the customer interface unit 10 further includes one or more syrup blocks 100. The syrup blocks 100 are mounted to the faucet plate 70 overlying a cutout 72B or 72D. The back wall of the syrup block 100 contains three inlet ports (not shown) for receiving end portions of syrup conduits 58 of the manifold assembly 46. It will be appreciated that the configuration of the manifold assembly 46 is such that only two syrup conduits 58 terminate within a given cutout 72B or 72D. The third inlet port in the back of the syrup block 100 is adapted to receive an end of a syrup conduit separate from the manifold assembly 46 to accommodate a "bonus flavor" syrup from a separate syrup source.

Three outlet ports 102 are formed in the front wall of the syrup block 100. A key slide 104 having keyhole shaped apertures 106 engages a channel in the front wall of the syrup block 100 to provide a quick-release means for connecting tubing to the outlet ports 102 of the syrup block 100.

Also shown in FIG. 7, a nozzle 40 has a generally cylindrical body 110. A mounting flange 112 (shown in greater detail in FIG. 9) is located adjacent the upper end of the cylindrical body 110 of the nozzle 40. The mounting flange 112 of the nozzle 40 is adapted to rest atop the bosses 68 projecting upward around the semicircular cutouts 66 in the lower platform 62 of the valve tray 60. Suitable threaded fasteners (not shown) extend through holes 113 in the mounting flange 112 and engage the bosses 68 to secure the nozzle in position. A female ring 114 is formed on the periphery of the cylindrical body 110 of the nozzle 40. A male half-ring portion is formed around the semicircular cutouts 66 in the lower platform 62 of the valve tray 60 and engages the rear portion of the female ring 114 on the nozzle 40. A cooperating male half-ring portion is also formed around a semicircular cutout in the lower end of the associated front cover 14. When the front cover 14 is closed, the two male half-ring portions on the valve tray 60 and the front cover 14 form a complete male ring portion which captures the female ring 114 of the nozzle 40.

Still referring to FIG. 7, a T-shaped connector 116 interconnects the nozzle 40 and the water module 94. The lower end of the downward extending conduit 118 of the connector 116 couples to the nozzle 40. The rearward end of the horizontally extending conduit 120 of the connector 116 couples to the outlet port 99 of the water module 94. A cylindrical fitting 122 extends through the horizontally extending conduit 120. O-rings in annular grooves adjacent the rearward end of the cylindrical fitting 122 form a fluid-tight connection with the water module 94. O-rings in annular grooves adjacent a head portion 124 at the forward end of the cylindrical fitting 122 prevent fluid from leaking out of the forward end of the connector 116.

Figure 8:
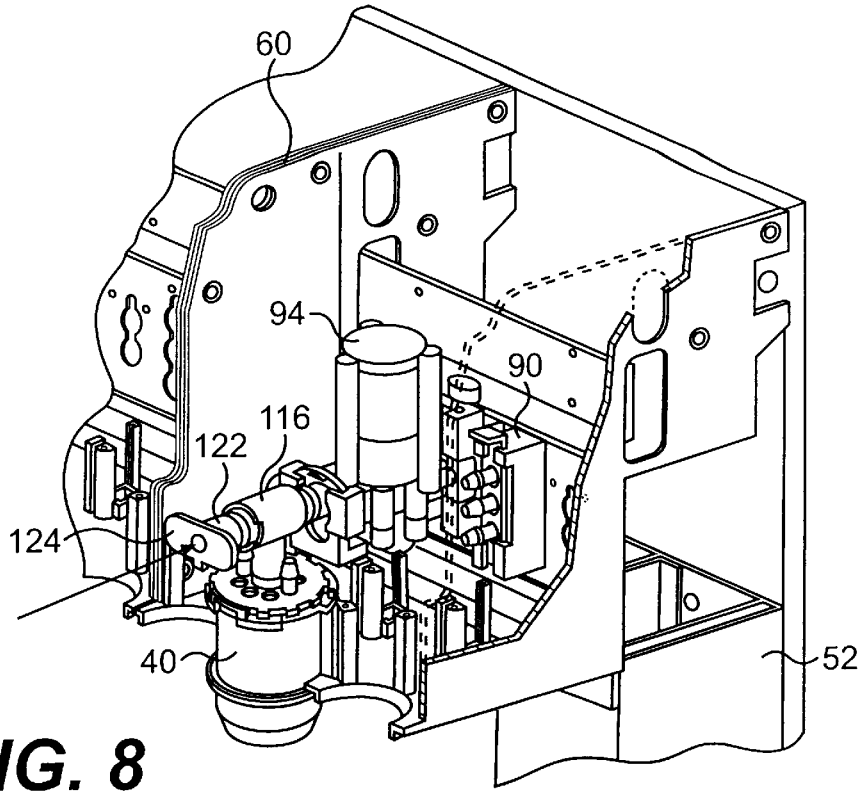
FIG. 8 depicts the valve tray of FIG. 7 with the nozzle and syrup connection block mounted to the faucet plate.

FIG. 8 illustrates the assembly of the nozzle 40 to its associated water module 94. With the water module 94 mounted to the faucet plate 70 by way of a water mounting block 90, the T-shaped connector 116 is assembled onto the nozzle 40. The nozzle is then advanced into position on the valve tray 60, the rearward end of the horizontally extending conduit 120 of the connector 116 engaging the outlet port 99 of the water module 94. When the mounting flange 112 of the nozzle 40 has been secured to the bosses 68 of the valve tray 60, the cylindrical fitting 122 is inserted into the front end of the connector 116 and advanced until the head portion 124 of the cylindrical fitting 122 confronts the forward end of the connector 116.

Figure 9:
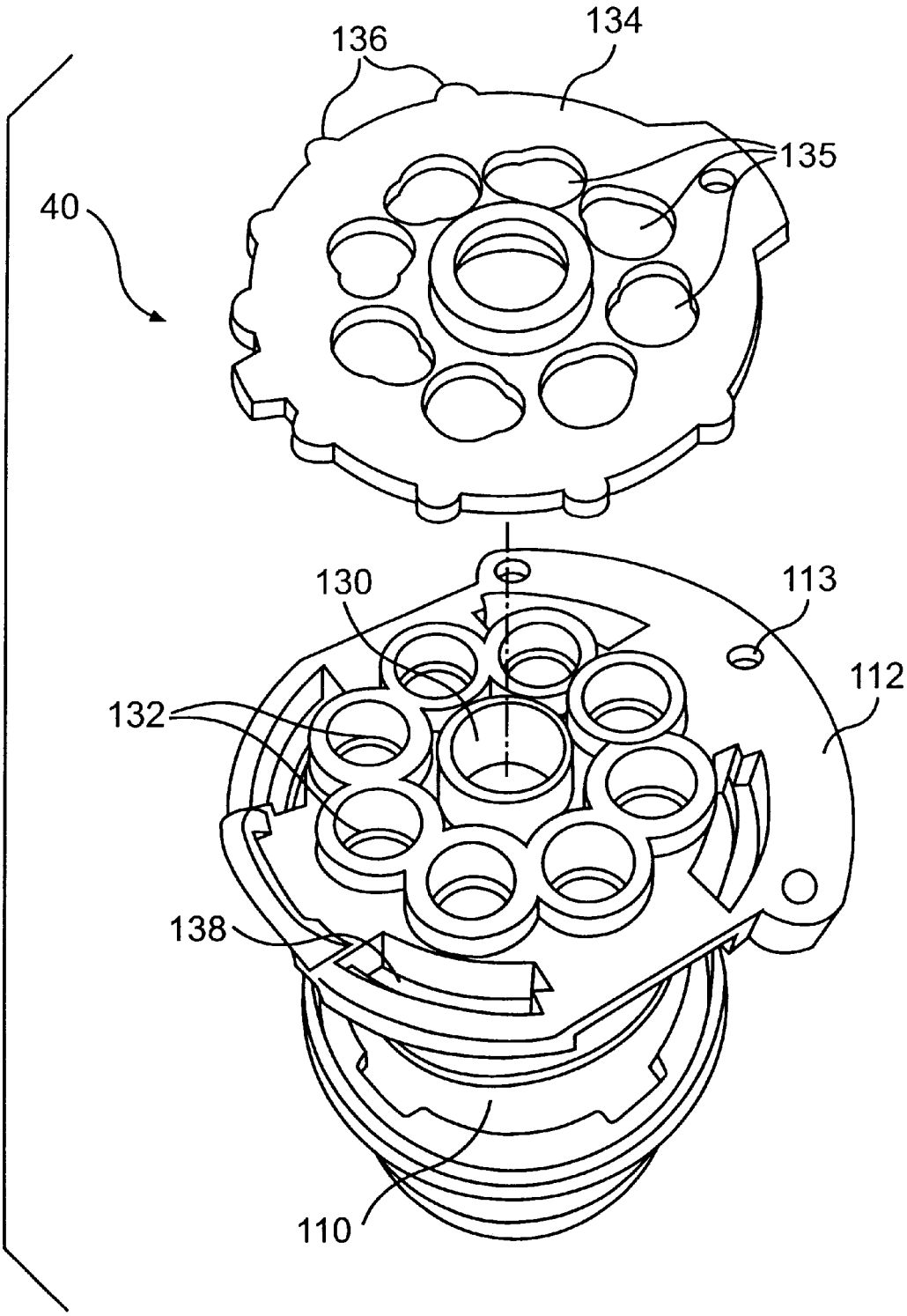
FIG. 9 is an exploded view of a nozzle.

FIG. 9 depicts the upper end of the nozzle 40 in greater detail. The upper end of the nozzle 40 includes a water inlet port 130 and a plurality of syrup inlet ports 132. A retainer 134 includes a corresponding plurality of keyhole-shaped apertures 135. Tabs 136 on the periphery of the retainer 134 engage slots 138 in the upper end of the nozzle 40 to rotatably secure the retainer to the upper end of the nozzle.

Figure 10:
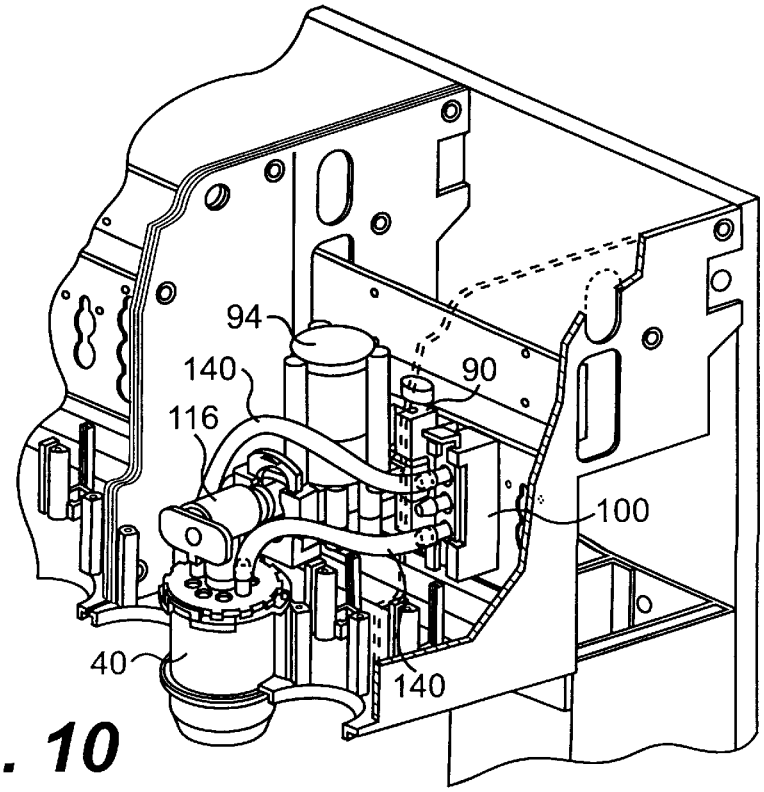
FIG. 10 illustrates the assembly of FIG. 8 with flexible tubing interconnecting the syrup connection block and the nozzle.

FIG. 10 illustrates further fluid connections to the nozzle 40. Flexible tubes 140 deliver syrup from the syrup blocks 100 to the nozzle 40. Each tube 140 has an enlarged connector (not shown) at each end. At one end, the enlarged connector is dimensioned to fit through the large portion of a keyhole shaped aperture 106 in the key slide 104 of a syrup block 100. Once the key slide 104 is displaced, the connectors cannot be withdrawn through the narrow portions of the keyhole shaped aperture 106, thereby securing the tubing to the syrup block 100. In a similar manner, the enlarged connector at the other end of the tube 140 is dimensioned to fit through the large portion of a keyhole shaped aperture 135 in the retainer 134. Once the retainer 134 is rotated, the connector at the end of the tube 140 cannot be withdrawn through the narrow portions of the keyhole-shaped apertures 135, thereby securing the tube to the nozzle 40.

As has previously been explained, the nozzle 40 shown in the drawings is a multi-flavor nozzle, which permits a variety of flavors of soft drinks to be dispensed through a single nozzle. It will be understood that single-flavor nozzles, not shown but well known to those of ordinary skill in the art, can be employed instead of, or in combination with, the multi-flavor nozzles 40. Such single-flavor nozzles include a water connection and only a single flexible syrup tube interconnecting a syrup block 100

Figure 11:
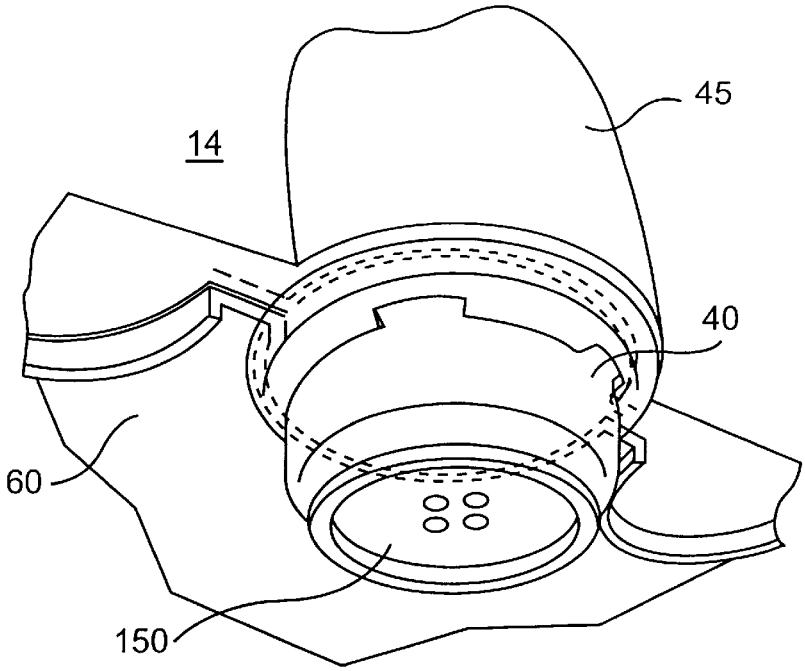
FIG. 11 is a bottom perspective view of a nozzle mounted to the customer interface unit of FIG. 1.

FIG. 11 depicts the lower or discharge end 150 of a nozzle 40. As can be seen from the drawings, the nozzle 40 is located forward of the water module 94, rather than beneath it as is the conventional design. A substantial portion of the nozzle 40 also lies forward of a plane defined by the front cover 14. By placing the nozzle 40 in this forward position, the nozzle is easily visible to the customer, facilitating proper placement of a cup 22 beneath the nozzle and reducing the possibility of spills.

Figure 12:
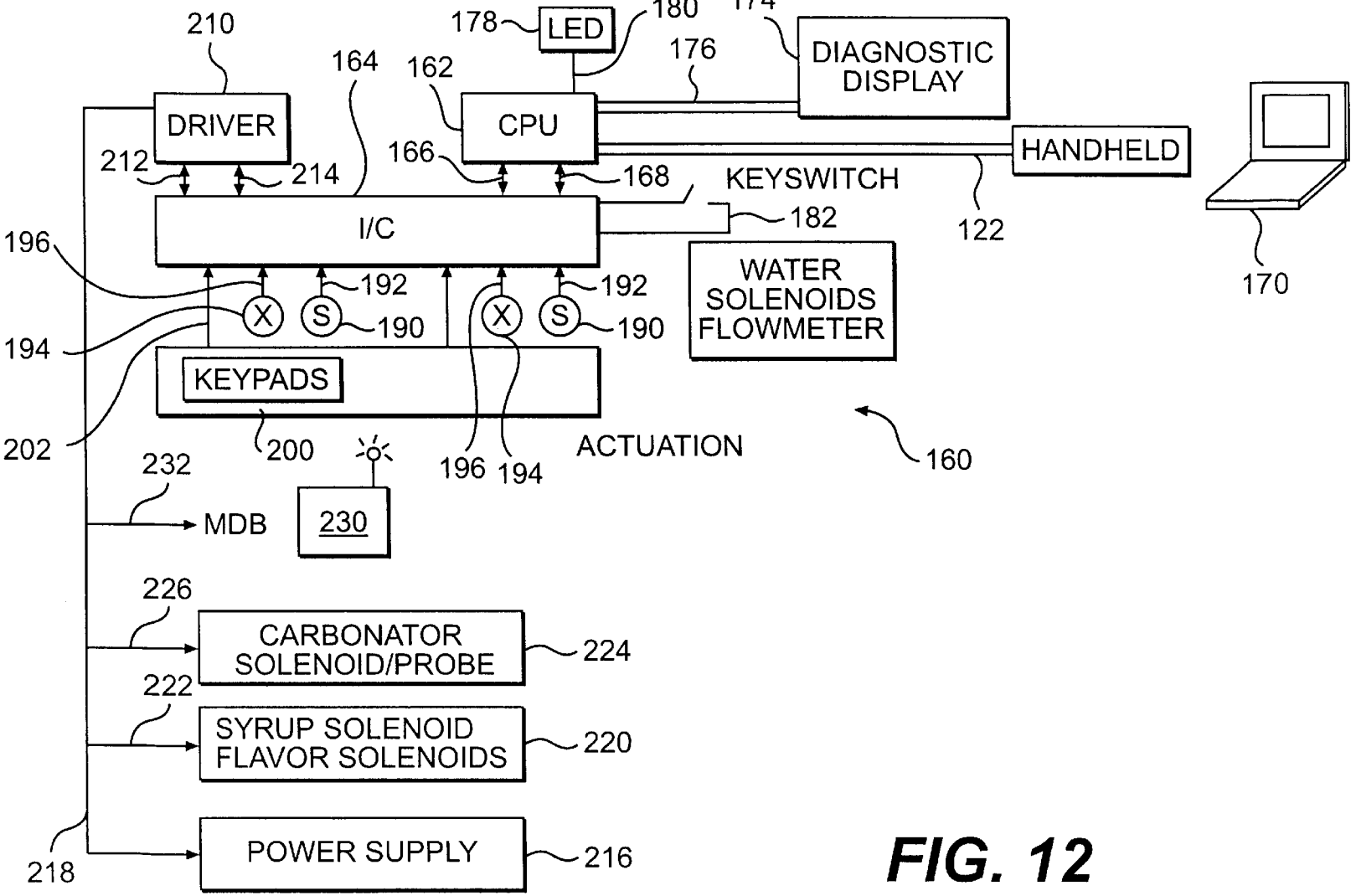
FIG. 12 is a schematic diagram of the control system of the customer interface unit of FIG. 1.

FIG. 12 is a schematic diagram of a control system 160 of the customer interface unit 10. The control system 160 is run by a CPU 162 which is mounted on the circuit board 88 (FIGS. 5 and 6). The CPU 162 issues and receives commands by way of an interconnect board 164, which is in communication with the CPU by way of signal paths 166, 168. The CPU can be programmed by a hand held computer 170, which interfaces with the CPU 162 by signal path 172. A diagnostic display 174 receives signals from the CPU 162 by way of signal path 176. A LED 178 receives signals from the CPU 162 by way of signal path 180 and glows to indicate that the control system 160 is powered up.

The control system 160 can be enabled or disabled by means of a key switch 182 which interfaces with the interconnect board 164.

The solenoids 190 of the water modules 94 are connected to the interconnect board 164 by signal paths 192. The flow meters 194 of the water modules 94 are connected to the interconnect board by means of signal paths 196. Key pads 200 on the front panels 14 of the customer interface unit 10 are electrically connected to the interconnect board 164 by a signal path 202.

A driver board 210 is electrically connected to the interconnect board 164 by signal paths 212, 214. The driver 210 communicates with a power supply 216 by means of a signal path 218. The driver 210 communicates with syrup solenoids and flavor solenoids 220 by way of a signal path 222. The driver communicates with a carbonator solenoid/probe 224 by means of a signal path 226. A multi-function bus 230 communicates with the driver board 210 by way of a signal path 232. The multi function bus 230 permits the control system 160 to communicate with the outside by way of wireless communications or a modem to permit remote monitoring of the customer interface unit 10, remote troubleshooting, and remote reprogramming of the CPU 162.

The valve trays 60 of the customer interface unit 10 provide advantages which might not be immediately apparent. For space planning purposes, customer interface units typically come in three standard widths: 38 cm (15 inches), 57 cm (22.5 inches), or 76 cm (30 inches), with the most common width being 57 cm (22.5 inches). The valve trays 60 of the customer interface unit 10 are each 19 cm (7.5 inches) wide. Thus two valve trays 60 can be arranged side-by-side for a customer interface unit 10 which is 38 cm (15 inches) wide, three valve trays can be arranged side-by-side for a customer interface unit which is 57 cm (22.5 inches) wide, and four valve trays can be arranged side-by-side for a customer interface unit which is 76 cm (30 inches) wide.

Another feature of the valve tray 60 is that it is configured as a multiple of a "space factor," where a space factor is the amount of space required for a dispensing position 12. A valve tray 60 that can accommodate three dispensing positions thus is three "space factors" in width. A plurality of valve trays 60 dimensioned in terms of "space factors" can thus be arranged to provide a desired number of dispensing positions 12 without wasting space. By adapting this modular approach, the inventory of different parts is reduced, and configuring and reconfiguring a customer interface unit is simplified.

Assembly and initial configuration of the customer interface unit 10 will now be explained. Unlike conventional customer interface units, which must be custom-configured and thus cannot be assembled until the restaurant's needs have been evaluated and an order placed, a great deal of the assembly of the customer interface unit 10 can be accomplished in advance to arrive at a "base configuration" which can be easily customized to the needs of a particular restaurant.

The faucet plate 70, valve trays 60, risers 52, and manifold assembly 46 are first assembled. In the customer interface unit 10 of the disclosed embodiment, the CIU is three space factors in width, or 57 cm (22.5 inches). Three valve trays 60 are thus arranged in side-by-side relation. At every water terminal location as defined by the openings 72A, 72C, and 72E in the faucet plate 70, a water mounting block 90 is installed. The outlets 56A, 56B of the water manifolds 54A, 54B are connected to their associated water mounting blocks 90, and the selector stem 93 of each water mounting block is set to the "off" position.

It is necessary for water mounting blocks 90 to be installed at every water terminal location because all of the outlets 56A, 56B of the water manifolds 54A, 54B will be hooked up to a water source and will be under pressure. In contrast, however, it is not necessary to mount syrup blocks 100 at all of the syrup terminal locations as defined by the openings 72B, 72D. Because each syrup tube 58 of the manifold assembly is an independent conduit, if a particular syrup conduit is not going to be used, it will simply not be hooked up to a syrup source at its input end.

The various components of the control system 200, such as the circuit board 88, are now installed. The top panel 18, side panels 16, and back panel are assembled. The base configuration of the customer interface unit 10 is now complete.

When an order for a customer interface unit 10 is received, the order will dictate which of the plurality of dispensing positions 12 will be operable, whether the nozzles 40 will be single flavor or multi flavor, whether the actuator mechanism at each dispensing station will be a button or a lever 28, and whether custom features such as unchilled water or bonus flavors are indicated. For each dispensing position 12 which will be operative, a water module 94 is mounted to the associated water mounting block 90, and a retainer clip 95 is installed to secure the water module to its respective water mounting block.

Syrup blocks 100 in a number sufficient to accommodate the desired number of syrup connections are mounted to the faucet plate 70 and connected to the corresponding syrup conduits 58. The locations on the faucet plate 70 at which the syrup blocks 100 are mounted are not critical, as flexible tubing 140 can be run from any given syrup block to any nozzle 40, even running to a nozzle in another valve tray 60. If the actuator mechanism for a particular dispensing position 12 is to be a lever 28, the lever and its associated circuit board are mounted to the valve tray by way of the bosses 69. For each dispensing position 12 a nozzle 40 is prepared by assembling the lower end of a t-shaped connector 116 onto the upper end of the nozzle. As the nozzle 40 is moved into position in its semi-circular recess 66 in the forward edge of the lower platform 62 of the valve tray 60, the rearward end of the t-shaped connector 116 engages the outlet port 99 of the associated water module 94. Also as the nozzle 40 is positioned within the semi-circular recess 66, the male half-ring portion on the periphery of the semi-circular recess 66 engages the rearward half of the female ring 114 on the periphery of the nozzle body 110. The mounting flange 112 of the nozzle rests atop the bosses. Threaded fasteners are inserted through the holes 113 in the mounting flange 112 and screwed into the bosses 68 to secure the valve to the valve tray 60. The cylindrical fitting 122 with its O-rings is then inserted into the forward end of the t-shaped connector 116 and advanced until the forward end of the fitting 122 couples to the outlet port 99 of the water module 94.

With the nozzles 40 now mounted to the valve trays 60 and the water connections to the nozzles made, flexible syrup tubes 140 are installed to effect a fluid connection between the syrup blocks 100 and the nozzles 40. As previously indicated, it may be appropriate to extend a flexible syrup tube 140 from a syrup block 100 to a remote nozzle 40, perhaps even to a nozzle mounted in another valve tray 60.

Hinged front covers 14 are now mounted to the customer interface unit. The front covers 14 are selected to have a number of rounded extensions 45 to correspond to the number of nozzles 40 which that cover will overlay. The front covers 14 may also be selected to have a width equal to an entire valve tray 60 (see, e.g., the left and right space factors in FIG. 1). In the alternative, several narrower covers having an aggregate width equal to a valve tray 60 can be employed (e.g., the center space factor in FIG. 1). Stated differently, the front covers 14 each have a width which is a multiple of a space factor (previously defined as the amount of space required for a dispensing position 12).

If a nozzle 40 is to be actuated by means of a front panel button, as is typically the case for a multi-flavor nozzle, then the front cover 14 is selected to have the appropriate button configuration. The front panel buttons are electrically connected to the control system by the ribbon connector 44 (FIG. 2). Assembly of the customer interface unit 10 is now complete.

In some installations, a customer interface unit may provide for a "bonus flavor," e.g., cherry or vanilla, to be mixed with the soft drink being dispensed. Because such bonus flavors are typically dispensed in relatively small quantities, they do not need to be chilled like regular syrup. The syrup can thus be stored in a different location, bypassing the chilling step, and tubing separate from the manifold assembly 46 can be run to a syrup block 100.

Ambient temperature water can similarly be run to a water block 94 separate from the manifold assembly 46. Since the center cutout 72C is the only cutout which is both a water mounting block 90 location and has accommodations for a third tube, i.e., has three circular portions instead of two, a conduit for ambient temperature water can be connected only to the center dispensing position 12 of a valve tray 60.

Reconfiguration of a customer interface unit 10 is equally easy. The front covers 14 are opened, and new water modules 94 and nozzles 40 can be added, and existing water modules and nozzles can be repositioned. To reposition a nozzle 40 and water module 94, the screws holding the nozzle on the valve tray 60 are removed, and the cylindrical fitting 122 of the t-shaped connector 116 is removed. The nozzle 40 can now be pulled forward to disengage it from the customer interface unit 10. The retainer clip 95 holding the water module 94 to its respective water mounting block 90 is removed, permitting the water module 94 to be disengaged from its water mounting block. The selector stem 93 of the water mounting block 90 is then moved to the "off" position.

To reinstall the water module 94 and valve 40 in a new dispensing position 12, or to add a new water module 94 and nozzle 40, the water module 94 is mounted to the water mounting block 90, and a retainer clip 95 is installed to retain the water module 94 on the water mounting block. The selector stem 93 of the water mounting block is moved to the desired "on" position to deliver either carbonated or non-carbonated water to the water module. A T-shaped connector 116 is mounted to the upper end of the nozzle 40, and the nozzle is advanced into position into one of the semi-circular recesses 66 in the forward edge of the lower platform 62 of the valve tray 60. As they nozzle 40 is moved into position, the forward end of the T-shaped connector 116 engages the outlet port 99 of the water module 94. When the nozzle 40 is in position, screws are inserted through the holes 113 of the mounting flange 112 of the nozzle and into the bosses 68 to secure the nozzle to the valve tray 60. The cylindrical fitting 122 is then inserted into the forward end of the T-shaped connector 116, as explained above. Syrup connections between the syrup blocks 100 and the nozzle 40 are then made by means of the flexible syrup tubes 140. Front covers 14 may need to be replaced to provide a cover with a different number of rounded extensions 45 or to provide a front cover with a button pad.

As can be seen, configuring and reconfiguring the customer interface unit 10 of the disclosed embodiment requires a minimum of plumbing and can easily be accomplished in the field.

A feature of the customer interface unit 10 is the location of the nozzles 40 at a forward location to facilitate visualization of the dispensing location 12 by the customer. One way in which this forward location is accomplished is by positioning the nozzles 40 at a location forward of the water module 94, instead of directly beneath it as is conventionally the case. Another way in which this forward location is accomplished is by positioning the nozzles such that a portion of the nozzle extends forward of a plane generally defined by the front of the customer interface unit 10.

Another feature of the customer interface unit 10 is the tiered arrangement of the nozzles 40, plumbing, and electronics. The plumbing, including the water mounting blocks 20, water modules 94, syrup blocks 100, and associated conduits and connectors, is mounted at a central location within the valve tray 60. The nozzles 40 are positioned at a location which is at the lower forward end of the valve tray 60, to facilitate visualization of the nozzles 40 by the customer as explained above. The electronics, including circuit board 88, are mounted at a location which is at the upper rearward end of the valve tray 60. The electronics are thus spaced apart from the plumbing both vertically and horizontally, thereby minimizing the possibility that a leak in the plumbing will damage sensitive electronic components.

Still another feature of the customer interface unit 10 of the disclosed embodiment is the utilization of a modular construction. The central module of the customer interface unit 10 is the valve tray 60. Depending upon the width of the customer interface unit 10, two, three, or four valve trays 60 may be required. The valve trays 60 also provide pre-defined mounting locations for nozzles 40, actuation levers 28, and the associated circuit boards. Finally, since the valve trays provide the support structure for the cladding, uniformity of side panels 16, top panels 18, and back panels and of the hinged front covers 14 is enabled. Side panels 16, for example, can always be identical, and inventory of top and back panels can be limited to three sizes. Similarly hinged front covers 14 need to be provided in only three sizes, a full-width size equal to the width of one valve tray 60, and one-third width size equal to one-third the width of the valve tray, or one "space factor." This modular approach reduces the number of parts which must be maintained in inventory and facilitates manufacture, repair, and reconfiguration.

Finally, it will be understood that the preferred embodiment has been disclosed by way of example, and that other modifications may occur to those skilled in the art without departing from the scope and spirit of the appended claims.

What is claimed is:

1. A machine for dispensing beverages which comprise a mixture of water and flavored syrup, said machine comprising:

a support structure;

a plurality of valve trays mounted on said support structure in side-by-side relation, each of said valve trays having a plurality of predefined dispensing locations formed on a lower surface thereof; and a nozzle mounted to said valve tray at one of said predefined dispensing locations.

2. The beverage dispensing machine of claim 1, wherein said plurality of valve trays comprises a plurality of substantially identical valve trays.

3. The beverage dispensing machine of claim 1, wherein said support structure comprises a plurality of holes formed therein, wherein said holes are accessible through said valve trays, and wherein said beverage dispensing machine further comprises:

a water manifold having a plurality of outlet tubes, each of which is aligned with one of said holes in said support structure; and a water connection block mounted to said support structure and having ports which couple to said outlet tubes of said water manifold.

4. The beverage dispensing machine of claim 1, wherein said support structure comprises a plurality of holes formed therein, wherein said holes are accessible through said valve trays, and wherein said beverage dispensing machine further comprises:

a plurality of syrup conduits, each of which has an end aligned with one of said holes in said support structure; and a syrup block mounted to said support structure and having ports which couple to said ends of said syrup conduits.

5. The beverage dispensing machine of claim 1, wherein said plurality of predefined dispensing locations formed on a lower surface of said valve tray are formed in a forward edge of said lower surface of said valve tray.

6. The beverage dispensing machine of claim 1, further comprising a front cover member pivotably mounted to one of said valve trays, said front cover member having a width equal to the width of said one of said valve trays.

7. The beverage dispensing machine of claim 1, wherein each of said dispensing locations has a predetermined, fixed width, and wherein said valve tray has a width which is a multiple of said predetermined fixed width of said dispensing locations.

8. The beverage dispensing machine of claim 1, further comprising exterior cladding, and wherein said plurality of valve trays comprise a frame to which exterior cladding is mounted.

9. The beverage dispensing machine of claim 3, wherein each of said valve trays comprises an upper tier which is horizontally and vertically spaced from said water connection block, and wherein said beverage dispensing machine further comprises electronic components disposed on said upper tier.

10. The beverage dispensing machine of claim 9, wherein said valve trays have side walls, and wherein said valve trays define openings in said side walls on said upper tier which align with like openings in a like valve tray disposed in side-by-side relation thereto, whereby electronic components which are too long to reside within a single valve tray can extend through said openings in said side walls across a plurality of valve trays.

* * * * *